US006499600B2

(12) United States Patent
Koyanagi

(10) Patent No.: US 6,499,600 B2
(45) Date of Patent: Dec. 31, 2002

(54) COMPRESSION SACK

(75) Inventor: Yoshihiro Koyanagi, Kashiwara (JP)

(73) Assignees: Kabushiki Kaisha Kashiwara Seitai, Osaka (JP); Yugen Kaisha Appeal, Nara (JP)

( * ) Notice: Subject to any disclaimer, the term of this patent is extended or adjusted under 35 U.S.C. 154(b) by 0 days.

(21) Appl. No.: 09/810,665

(22) Filed: Mar. 19, 2001

(65) Prior Publication Data

US 2002/0044702 A1 Apr. 18, 2002

(30) Foreign Application Priority Data

Oct. 12, 2000 (JP) ..... 2000-311908

(51) Int. Cl.[7] ..... B65D 81/20
(52) U.S. Cl. ..... 206/524.8; 383/100
(58) Field of Search ..... 383/100, 103; 206/524.8

(56) References Cited

U.S. PATENT DOCUMENTS 3,237,844 A * 3/1966 Hughes ..... 383/100
4,581,764 A * 4/1986 Plock et al. ..... 383/101
5,380,093 A * 1/1995 Goldman ..... 210/464
5,540,500 A * 7/1996 Tanaka ..... 383/100
5,544,752 A * 8/1996 Cox ..... 206/524.8
5,701,996 A * 12/1997 Goto et al. ..... 206/287
5,894,929 A * 4/1999 Kai et al. ..... 206/524.8
5,973,768 A * 10/1999 Mazion et al. ..... 355/72
6,045,264 A * 4/2000 Miniea ..... 383/100
6,116,781 A * 9/2000 Skeens ..... 206/524.8
6,200,027 B1 * 3/2001 Jones ..... 210/464

FOREIGN PATENT DOCUMENTS

JP 07-009592 1/1995
JP 08-268441 10/1996
JP 09-048473 2/1997

* cited by examiner

*Primary Examiner*—Stephen P. Garbe
(74) *Attorney, Agent, or Firm*—Birch, Stewart, Kolasch & Birch, LLP

(57) ABSTRACT

A compression sack constituted by non-breathable front and back sheets and having an opening formed in a part of the compression sack. The opening includes an access port for articles and air outlet, and closing means provided therein for tight closing and opening purposes. The access port and air outlet are separated by a separating member at which the front and back sheets are firmly joined together. The separating member extends from a side of the opening inwardly of the compression sack, thereby forming a deaeration passage between the air outlet and the inside of the compression sack. A spot seal is provided more inwardly of the sack than the end at the interior side of deaeration passage, and the separating member is bent at the end of the interior side of the deaeration passage in a direction of the deaeration passage.

11 Claims, 9 Drawing Sheets

COMPRESSION SACK

BACKGROUND OF THE INVENTION

The present invention relates to a compression sack for compactly containing articles, such as clothing or bedclothes, which have been compressed by deaerating the sack.

Compression sacks of this type have been disclosed by Japanese Laid Open Patent Application Nos. 7-9592, 8-268441, and 9-48473. These sacks have an article access port and air outlet provided in a part thereof.

In these prior art compression sacks, articles such as clothing are put into the compression sack; then a zipper on the access port is closed, and the air inside the compression sack is discharged from the air outlet to the outside by pressing the compression sack manually or sucking out the air using a vacuum cleaner. The air outlet is then zipped up to close the compression sack tightly.

If the compression sack containing, e.g., clothing or bedclothes, is deaerated, the air inside the contents will be discharged outside of the sack simultaneously, thus resulting in a decrease in the volume of the contents. Consequently, packing can be made more compact due to the reduction in volume.

However, with such conventional compression sacks, some of the contents may be caught in the air outlet due to suction from the air stream created during deaeration. Additionally, in the compression sack disclosed by the JP '441, the passage area of the air outlet is coated with adhesive matter which serves as a shut-off valve by channeling the flow of air in the passage. The nature of the air stream may also cause the contents to become polluted by the adhesive matter, depending on the position of the contents.

The present invention is intended to solve these problems.

BRIEF SUMMARY OF THE INVENTION

To overcome the above-noted problems, in a first aspect of the present invention, a compression sack is provided which comprises non-breathable sheets 11, 12. An opening 2 formed in a part of the compression sack 1 includes an access port 21 for articles, an air outlet 22, and closing means 3 provided therein for tight closing and opening. The access port 21 and air outlet 22 are separated by a separating member 4, the front and back sheets 11, 12 of which are firmly joined together. The separating member 4 extends from a side 13 of the opening 2 inwardly of the compression sack 1, thereby forming a deaeration passage 5 between the air outlet 22 and the inside of the compression sack 1. A spot seal 6 is provided more inwardly of the sack than an end (a) at the interior side of the deaeration passage 5.

In a second aspect of the present invention, the compression sack of the first embodiment includes an auxiliary deaeration passage 7 provided more inwardly of the sack than a point where the separating member 4 and the closing means 3 cross each other.

In a third aspect of the present invention, the compression sack of the first or second embodiment contains shut-off seals 8, 8, 8 formed within the deaeration passage 5, and act as labyrinth seams for channeling the flow of air as it exits the deaeration passage 5.

In a fourth aspect of the present invention, the compression sack of the first or second embodiment has a liquid sealing portion 9 formed within the deaeration passage 5.

In a fifth aspect of the present invention, in the compression sack of the first or second embodiment, the separating member 4 is bent at the end (a) of the interior side of the deaeration passage 5 in a direction of the deaeration passage 5.

BRIEF DESCRIPTION OF THE DRAWINGS

The present invention will become more fully understood from the detailed description given hereinbelow and the accompanying drawings, which are given by way of illustration only, and thus are not limitative of the present invention, and wherein.

DETAILED DESCRIPTION OF THE PREFERRED EMBODIMENT

In following description, a direction of the opening 2 side of a compression sack 1 is referred as the "upper section", and a direction of the opposite side is referred to as the "lower section".

Figure 1:
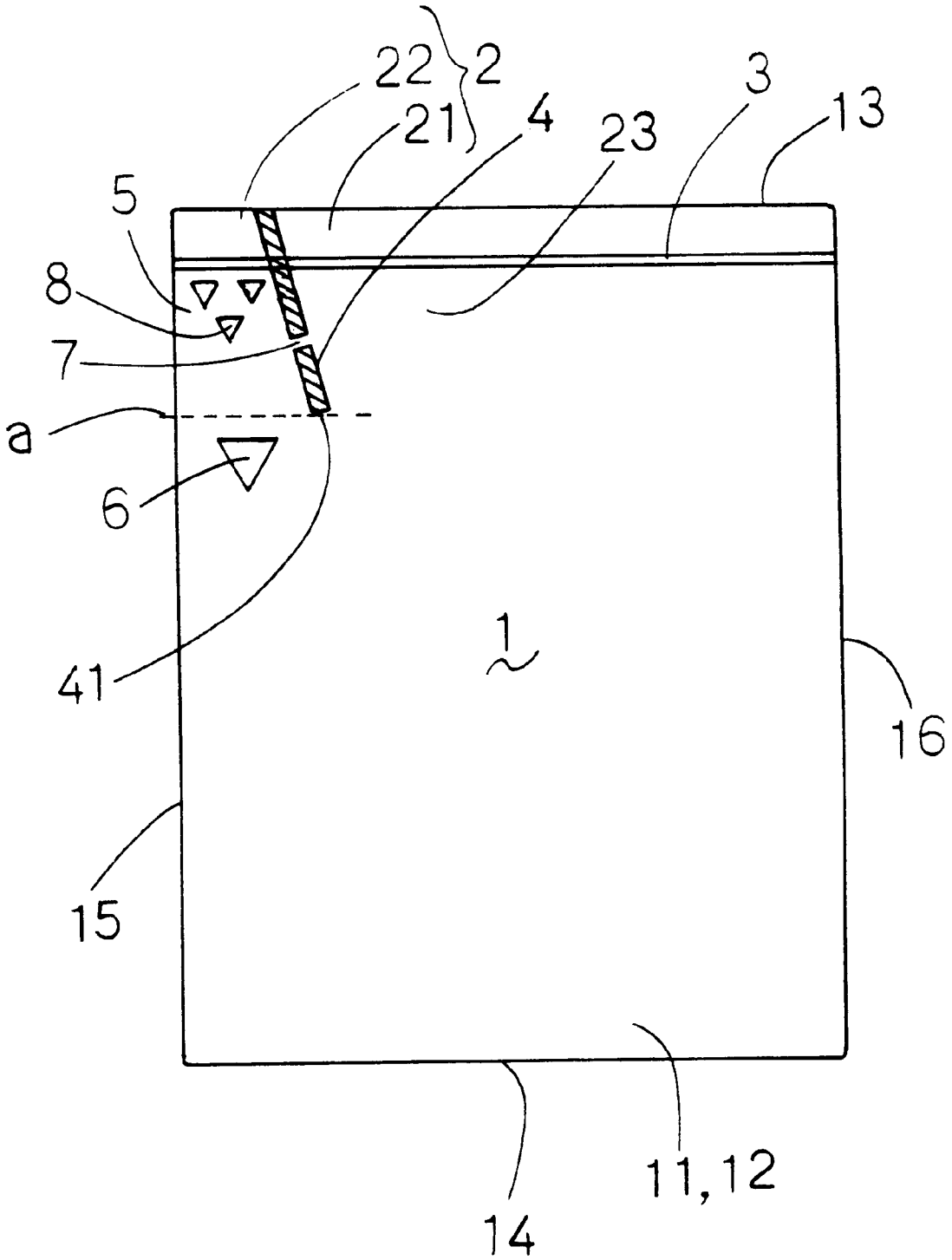
FIG. 1 is a front view of a compression sack in accordance with a first embodiment of the present invention.

FIG. 1 is a plan view of the compression sack 1 in accordance with the present invention. The compression sack 1 is formed by a bag which is rectangular viewed from the front and composed of non-breathable sheets 11, 12 made of, e.g., resin. An upper side 13 of short length includes an opening 2, a bottom side 14, and closed lateral sides 15, 16. The opening 2 is divided by a separating member 4 into a broad part and a narrow part. The broad part is the access port 21 to articles, and the narrow part an air outlet 22. That is, both the parts are positioned adjacent to each other at the upper side 13. The opening 2 may be tightly closed and released by a zipper 3 as closing means. A deaeration passage 5 is formed by the separating member 4 and lateral side 15, which extends from the air outlet 22 to the interior of the sack. A spot seal 6 is provided in a position under the end (imaginary line (a)) at the interior side of the deaeration passage 5, with shut-off seals 8, 8 in an upper position of the deaeration passage 5.

Letters representing trade names or directions, or patterns may be printed on the surfaces of sheets 11, 12, and the sheets 11, 12 themselves may be subjected to antibacterial or deodorizing treatment. The compression sack 1 may be made in any size according to the goods to be contained, such as clothing, blankets, bedclothes, etc.

Figure 2:
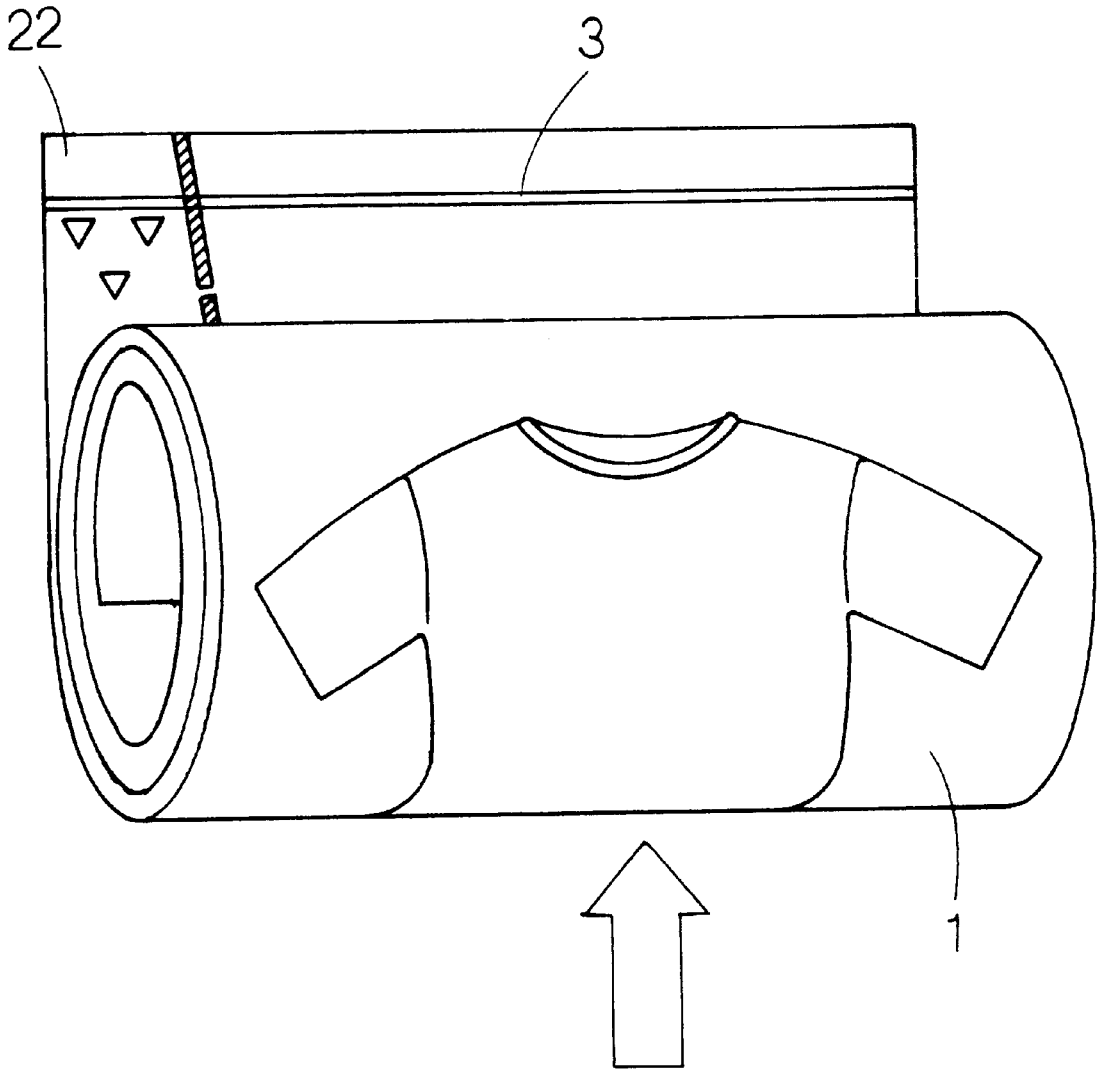
FIG. 2 is an explanatory view illustrating how to use the compression sack in accordance with the first embodiment of the present invention.

To use the compression sack 1, zippers 3 provided at the access port 21 and air outlet 22 sections are kept open. Then, articles to be contained, such as clothing, are put into the compression sack 1 through the open access port 21, and the zipper 3 of the access port 21 section is closed. As shown in FIG. 2, the compression sack 1 is then compressed by manually rolling it up from the lower part thereof so that air inside the compression sack 1 is removed from the air outlet 22, which is still open. The zipper 3 of the air outlet 22 section is then closed, whereby the compression sack 1 is tightly closed.

The opening 2 comprises the access port 21 and the air outlet 22. The front and back sheets 11, 12 are bonded together by heat-sealing in their optional sections extending from the opening 2 downward, thereby forming the separating member 4. The separating member 4 bisects the opening 2 into a broad section and a narrow section. Of the two sections, the former is the access port 21, and the latter the air outlet 22, so that deaeration passage 5 is formed extending from the air outlet 22 to the interior of the compression sack 1. In all embodiments of the present invention, the air outlet 22 is formed in a single position, but it may be provided in two or more positions as needed.

Figure 3:
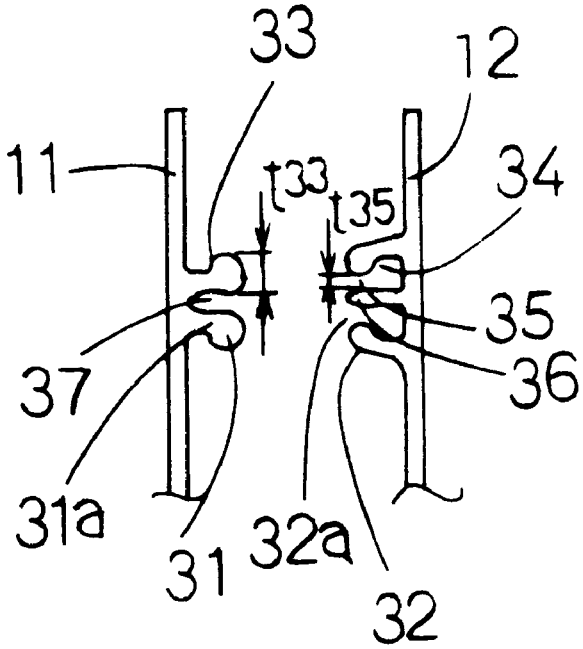
FIG. 3(A) is an end view of a zipper remaining opened in accordance with the first embodiment of the present invention.
FIG. 3(B) is an end view of the zipper remaining closed in accordance with the first embodiment of the present invention.
FIG. 3(C) is an enlarged view of a tab in accordance with a second embodiment of the present invention.
Figure 3:
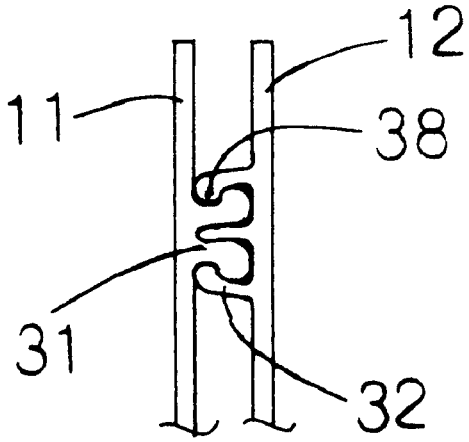
Figure 3:
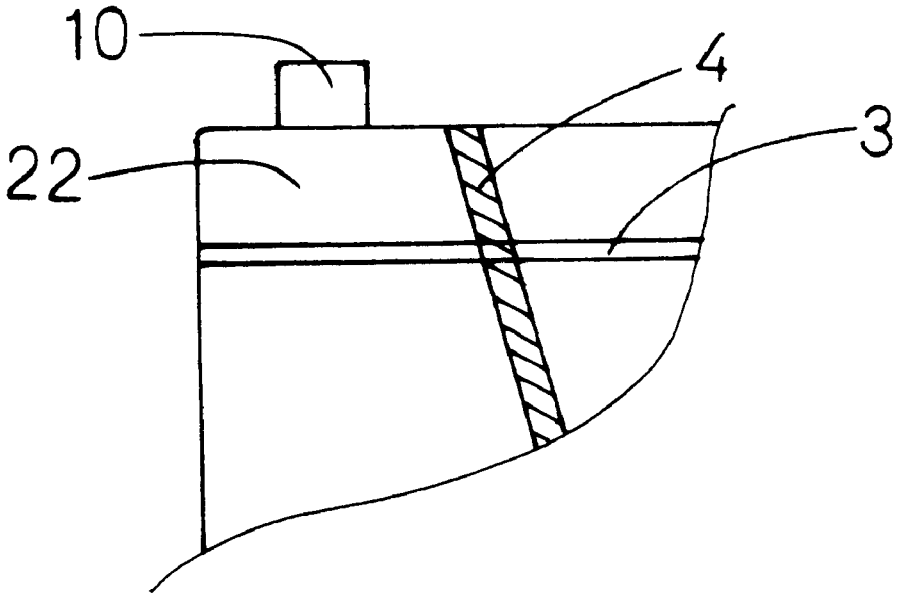

The zipper 3, provided as the closing means of the opening 2, is a snap-fastener type of zipper. As shown in FIG. 3(A), the sheet has a raised linear portion 31 formed at one side in the interior thereof and a depressed linear portion 32 at the other side.

The raised and depressed linear portions 31, 32 include catching portions 33, 34 respectively. The depressed linear portion 32 is formed with a convex section 36, and the raised linear portion 31 is formed with a concave section 37, both sections being intended for airtight sealing. The raised linear portion 31 has two raised pieces 31*a*, 31*a* formed opposed to each other with the concave section 37 interposed between said two pieces, while the depressed linear portion 32 has depressed lines 32*a*, 32*a* formed opposite each other with the convex section 36 interposed between said depressed lines.

The width t35 of the pathway 35 of depressed line 32*a* is made smaller than the width t33 of the catching portion 33. With the zipper 3 being kept closed, if the raised and depressed linear portions 31, 32 are pressed against each other, the catching portion 33 may move forward so as to urge the pathway to open until it engages with the catching portion 34 of the depressed linear portion 32, as shown in FIG. 3(B). In such an engaged position, a gap 38 between both portions is almost nil. Additionally, it may become so restricted that no outside air is allowed to enter with the result that the compression sack 1 can remain closed while its interior can be kept airtight.

The zipper 3 of any kind can be employed so long as it serves to render the compression sack 1 airtight.

To facilitate closing of the zipper 3, a slider made of resin may be provided in a position of the zipper 3 at the sack's exterior side. The width of the air outlet 22 is narrow as compared with that of the opening 2. This makes it difficult to open the zipper 3 when closed. Thus, as illustrated in FIG. 3(C), a part of at least one of the sheets 11, 12 may be made longer, or a separate sheet-like piece may be attached to the sheet so as to serve as a tab 10, which is large enough to be grasped with fingers.

The separating member 4 is not limited in configuration to what is shown in FIG. 1. It may assume different forms according to specific applications. Examples of variations are shown in FIGS. 4(A)–(D).

Figure 4A:
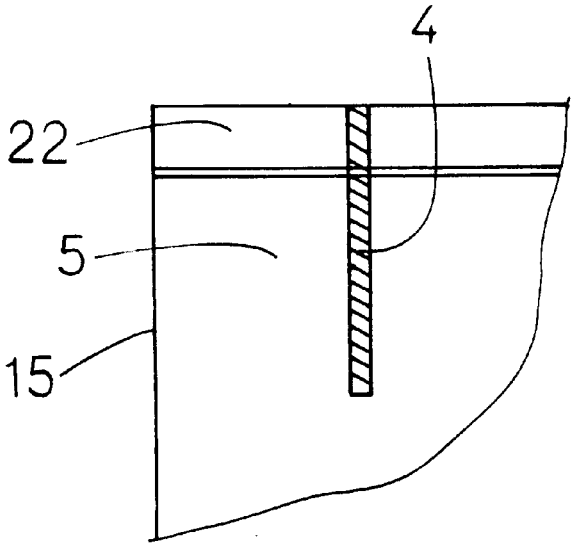
FIGS. 4(A)–(D) are enlarged views showing separate forms of the separating member.

In FIG. 4(A), the separating member 4 and the lateral side 15 of the sack are designed to run parallel to each other, i.e., perpendicular to each other, so that the upper and lower sections of the deaeration passage 5 may become equal to each other in width.

Figure 4B:
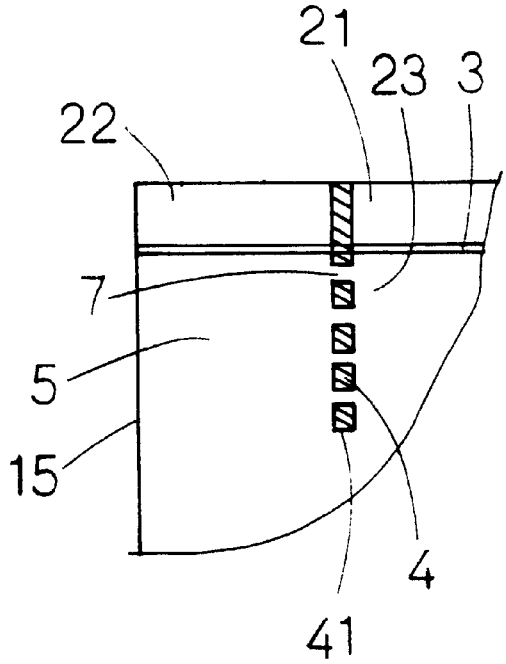

In FIG. 4(B), as in FIG. 4(A), the upper and lower sections of the deaeration passage 5 are equal to each other in width; that is, the separating member 4 and the lateral side of the sack are parallel with each other, and the shape of the separating member 4 is like an intermittent straight line. Disconnected pieces of the separating member 4 are auxiliary deaeration passages 7, . . . 7. In the interior of the access port 21, this configuration has the advantage of discharging via the auxiliary deaeration passages 7, . . . 7 air present in a space 23 within the access port 21 and between the leading end 41 of the separating member 4 and the zipper 3 during deaeration.

Figure 4C:
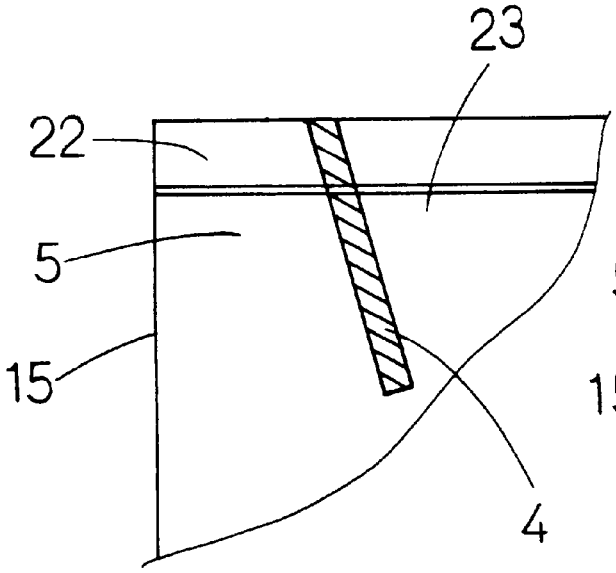
Figure 4D:
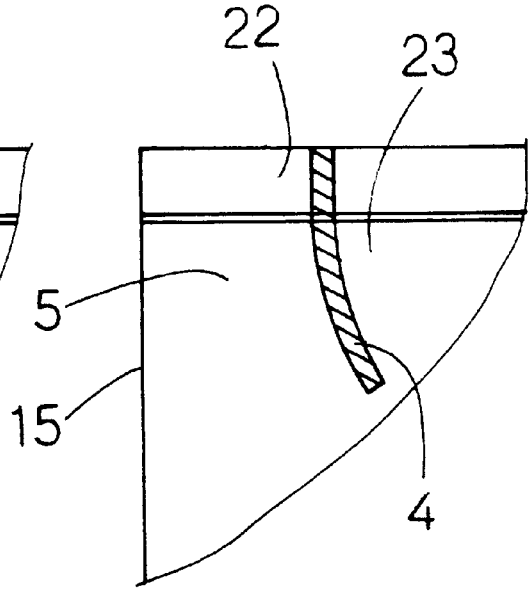

As shown in FIGS. 4(C) and 4(D), the separating member 4 runs at an angle so that it is not parallel to the lateral side 15. More specifically, the separating member 4 is arranged such that the distance between the separating member 4 and the lateral side 15 of the sack, i.e., the width of the deaeration passage 5, broadens downwardly of the sack. The separating member 4 is formed in a straight line, as shown in FIG. 4(C), and in a curved line, as shown in FIG. 4(D). With these configurations, the deaeration passage 5 tends to widen toward the lower portion, so that air within the sack can be easily introduced into the deaeration passage 5 and, accordingly, quickly removed.

The form of the separating portion 4, as illustrated by FIG. 1, is a combination of the forms shown in FIGS. 4(B) and (C), wherein the auxiliary deaeration passage 7 is provided at a point near and below the shut-off seals 8, 8, 8, which act to channel the flow of air as it exits the deaeration passage 5.

The form of the separating member 4 is not limited to those shown in FIGS. 1 and 4. It is desirous to select an optimum form taking into consideration the shapes of articles to be contained, or the relationship with spot seal 6, shut-off seal 8 or liquid sealing portion 9 as described below.

Figure 5:
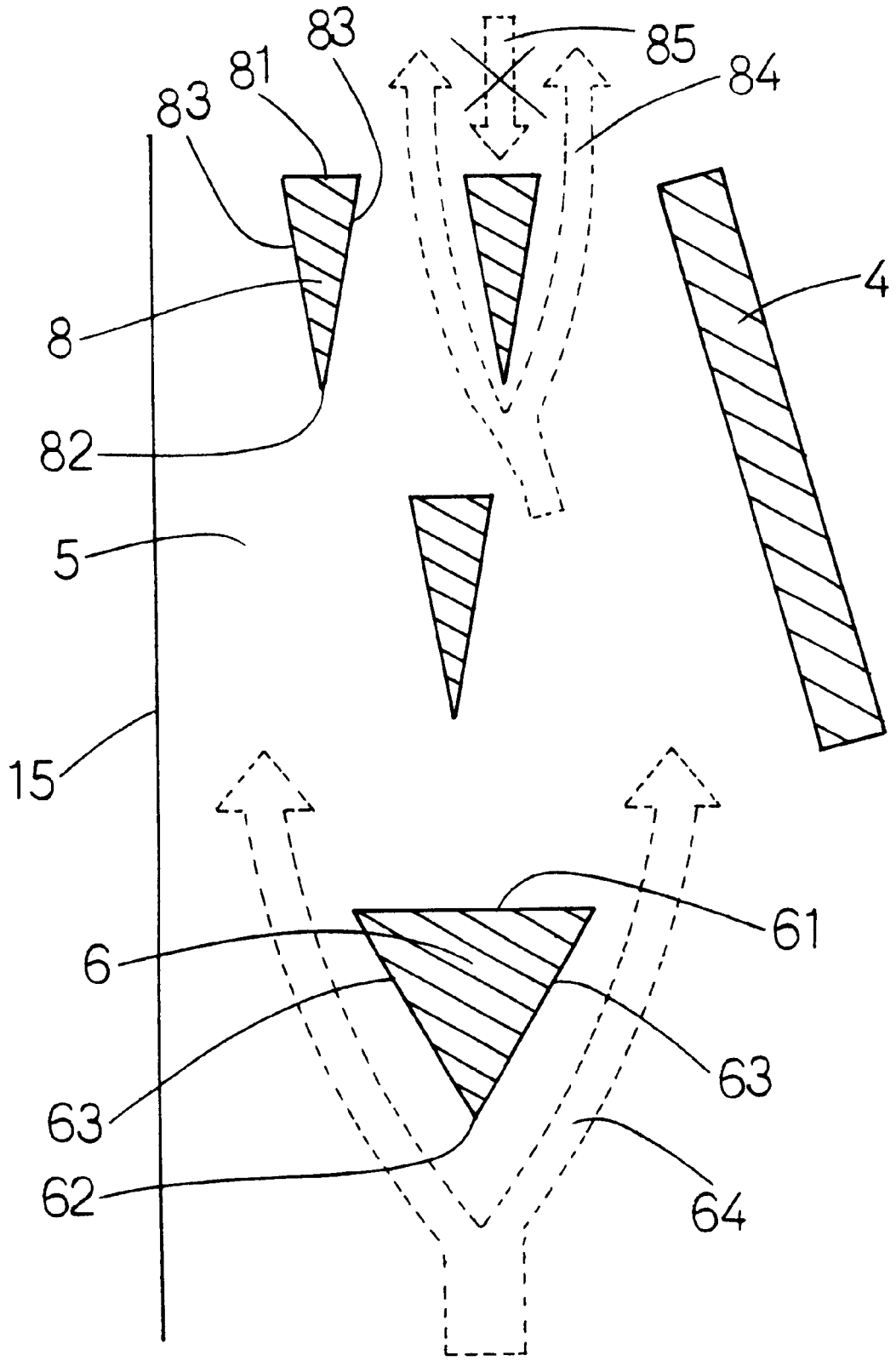
FIG. 5 is an enlarged view showing a spot seal and shut-off seal in accordance with the embodiment of the present invention.
Figure 6A:
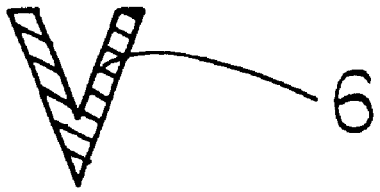
FIGS. 6(A)–(D) are enlarged views showing separate forms of the spot seal.
Figure 6B:
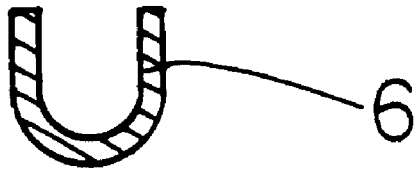
Figure 6C:
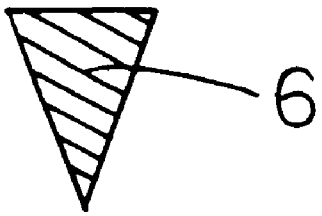
Figure 6D:
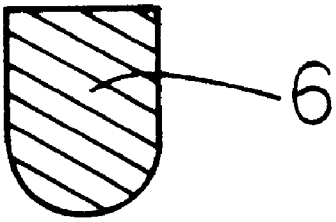

As shown in FIGS. 1 and 5, the spot seal 6 is provided below the deaeration passage 5 or in a position slightly under the imaginary line (a), extending side by side with the upper side 13 with reference to the leading end 41 of the separating member 4. The spot seal 6 is provided by a hot sealing operation, similar to the way that the separating member 4 was formed. This may prevent articles, such as clothing, contained in the compression sack 1 from being caught in the deaeration passage 5 by the air stream in deaeration. Additionally, it may serve to improve an air flow 64 when deaeration takes place.

In an embodiment of the present invention, the spot seal 6 is an inverted regular triangle viewed from the front and comprising an upper end 61, lower end 62, side portions 63, 63. As shown in FIG. 5, the upper end 61 corresponds to the bottom side, which is positioned in the upper side in the inverted triangle. Side portions 63, 63 correspond to two other sides, and the lower end 62 corresponds to the apex in the lower side. Since this configuration widens upwardly and tapers downwardly, the air flow 64 from the lower portion to the upper portion, i.e., from the inside of the sack to the outside, may be improved, and air may be introduced into the deaeration passage 5 more smoothly.

The shape of the spot seal 6 is not limited to those shown in FIGS. 1 and 5, and may be varied for specific applications. Examples of variations are shown in FIGS. 6(A)–(D). In the drawings, the air outlet 22 (not shown) is located in the upward direction. The spot seals, which take the shape of V and U when viewed from the front, may be subjected to contact bonding only at the external portion as in FIGS. 6(A) and 6(B), or at the entire portion as in FIGS. 6(C) and 6(D). The spot seal may be provided in a plurality of locations, not just in a single place. The rectifying effect of air cannot be expected in any spot seal other than in the shapes described. For example, in order to impress users with a decorative compression sack 1, a spot seal featuring a popular character may be used.

The shut-off seal 8 is made smaller than the spot seal 6 and is attached by means of hot sealing within the deaeration passage 5, as shown in FIGS. 1 and 5.

In the embodiment of the present invention shown in FIG. 5, the shutoff seal 8 is an inverted regular triangle when viewed from the front and comprises an upper end 81, a lower end 82, and sides 83, 83. The upper end 81 corresponds to the bottom side, which is positioned in the upper side of the inverted triangle. The side portions 83, 83 correspond to two other sides, and the lower end 82 corresponds to the apex in the lower side. Two shut-off seals 8 are positioned above the deaeration passage 5, and another is positioned below said two shut-off seals. This configuration widens upwardly and tapers downwardly, thereby improving the air stream 84 from the lower portion to the upper portion, i.e., from the inside of the sack to the outside. Conversely, in the case of air stream 85, running from the upper portion to the lower portion, i.e., from the outside of the sack to the inside, the upper end 81 serves to disturb the flow of air in such a manner that the shut-off seal 8 may work as a shut-off valve.

Figure 7A:
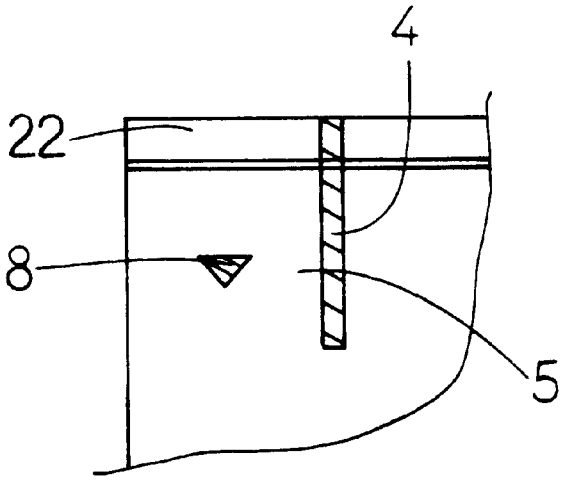
FIGS. 7(A)–(D) are enlarged views showing separate forms of the shut-off seal.
Figure 7C:
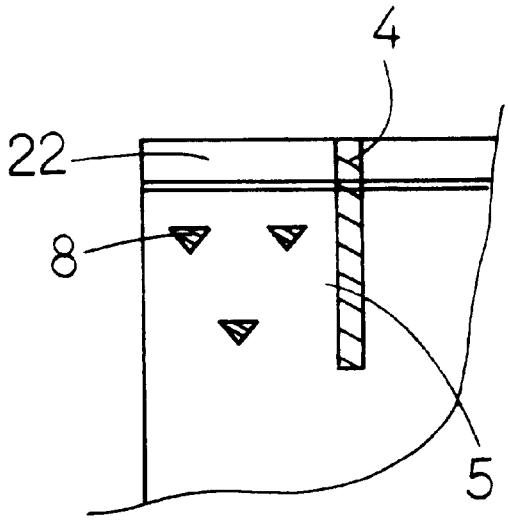
Figure 7B:
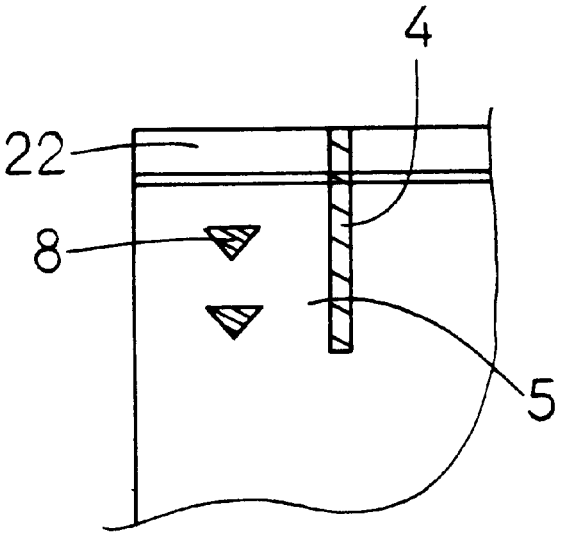
Figure 7D:
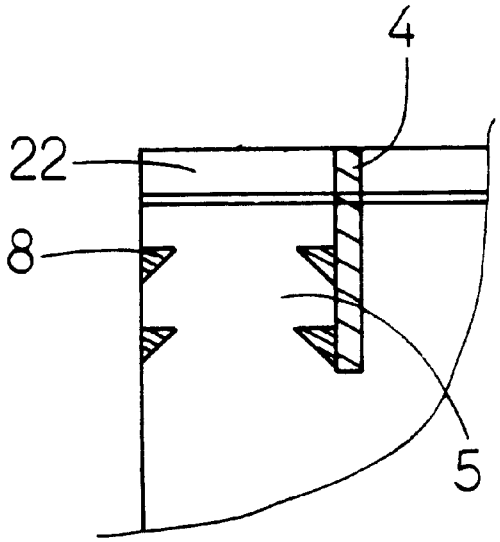

The shut-off seal 8 is not limited in form to the position inside the deaeration passage 5, and in number to those shown in FIGS. 1 and 5. Appropriate variations may be made based on the specific use. Examples of variations are illustrated in FIG. 7. The number of places where the shut-off seal 8 is positioned is one in FIG. 7(A), two in FIG. 7(B), and three in FIG. 7(C). In any of these instances, the shut-off seal 8 is located almost in the center of the deaeration passage 5. In FIG. 7(D), the shut-off seals 8 are provided in four places, each positioned at the right and left end portions in the deaeration passage 5.

Figure 8:
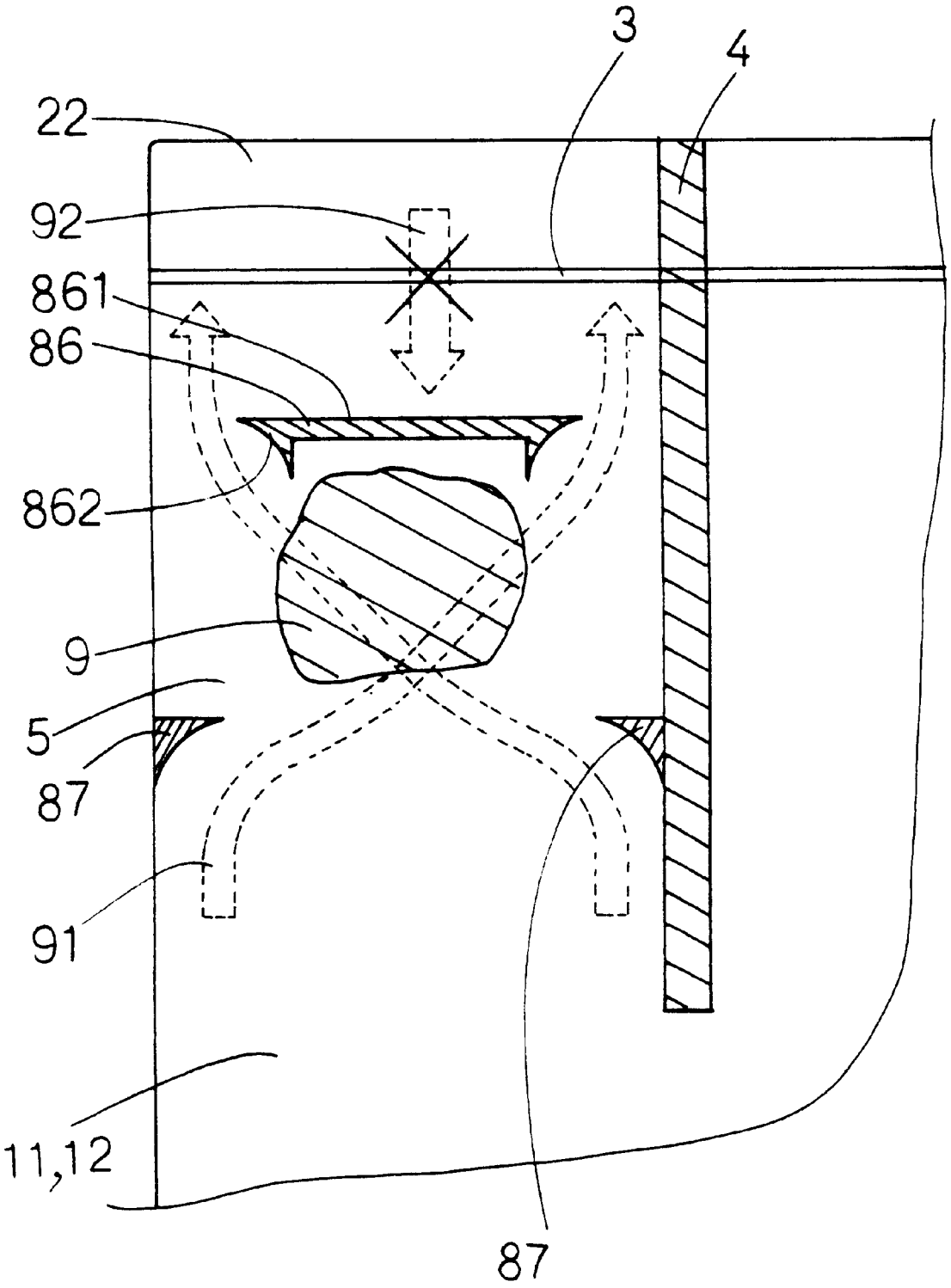
FIG. 8 is an enlarged view of a compression sack in accordance with a third embodiment of the present invention.

In another embodiment of the present invention, the deaeration passage 5 may include a liquid sealing portion 9. In this embodiment, as shown in FIG. 8, the deaeration passage 5 has an upper shut-off seal 86 formed in the upper part thereof, and lower shut-off seals 87, 87 disposed in the lower part thereof so that the liquid sealing portion 9 may be interposed between said shut-off seals. Each of shut-off seals 86 and 97 act to channel airstreams 91 and liquid sealing portion 9 and out toward the air outlet 22.

The upper shut-off seal 86 consists of a shut-off member 861 and rectifying members 862, 862. The shut-off member 861 is disposed extending laterally from the center of the deaeration passage 5 and serves to prevent movement of inactive liquid sealed off in the liquid sealing portion 9 and backflow from air stream 92. The rectifying members 862, 862 are provided in the right and left ends of the shut-off member 861. The rectifying members 862, 862 each takes the shape of a right isosceles triangle, with a side interposed between two equilateral sides (linear) curving inwardly, said equilateral sides being positioned in the upper and lateral portions. Said lateral portions are connected with the right and left ends of the shut-off member 861, and said upper portion is arranged such that it may be in alignment with the upper end of the shut-off member 861. The rectifying members 862, 862 serve to prevent movement of inactive liquid sealed off in the liquid sealing portion 9 and rectifying air streams 91, 91 which have passed through the liquid sealing portion 9, to guide them smoothly to the deaerating portion 22.

The lower shut-off seals 87, 87 take the form of a right isosceles triangle, with a side interposed between two equilateral sides (linear) curving inwardly, said equilateral sides being positioned in the upper and lateral portions and mounted symmetrically on the separating member 4 and the lateral portion 15, respectively, in such a manner that said inwardly curving sides may face the center of the deaeration passage 5. The lower shut-off seals 87, 87 serve to prevent movement of inactive liquid sealed off in the liquid sealing portion 9 and rectifying air streams 91, 91 which are ready to pass through the liquid sealing portion 9.

The liquid sealing portion 9 is intended as a shut-off valve. It encloses low viscosity inactive liquid such as silicone oil. In the a neutral condition, when articles are contained in the compression sack 1, the front and back sheets 11, 12 remain in close contact with each other by means of said inactive liquid within the liquid sealing portion 9 so that they may cooperate with the zipper 3 of the air outlet 22 and the shut-off member 861 of the upper shut-off seal 86 to prevent ingress of external air. During deaeration, the sheets 11, 12, which are temporarily kept in close contact with each other under air pressure in the liquid sealing portion 9, are moved apart from each other by forcing the air streams 91, 91 to move from the inside of the sack to the outside, thus establishing a passageway for air. After deaeration is over, the sheets 11, 12 return to their original close contact. In order to avoid any leakage of inactive liquid within the liquid sealing portion to the outside of the deaeration passage 5, liquid pools are formed in the specific sites within the passage situated between the upper shut-off seal 86 and the lower shut-off seals 87, 87. Even if inactive liquid leaks into the sack for some reason, the presence of the spot seal 6 (not shown in FIG. 8) in the lower position of the deaeration passage 5 hinders leaked inactive liquid from dispersing throughout the sack.

The upper shut-off seal 86 and the lower shut-off seals 87, 87 are not limited in shape to those shown in FIG. 8, and variations may be made accordingly. Furthermore, the provision of the upper shut-off seal 86 or the shut-off seals 87, 87 is not essential. In other words, the liquid sealing portion 9 may be constituted by other means.

The present invention may be embodied by separate variations other than the embodiments which have been described so far.

Figure 9:
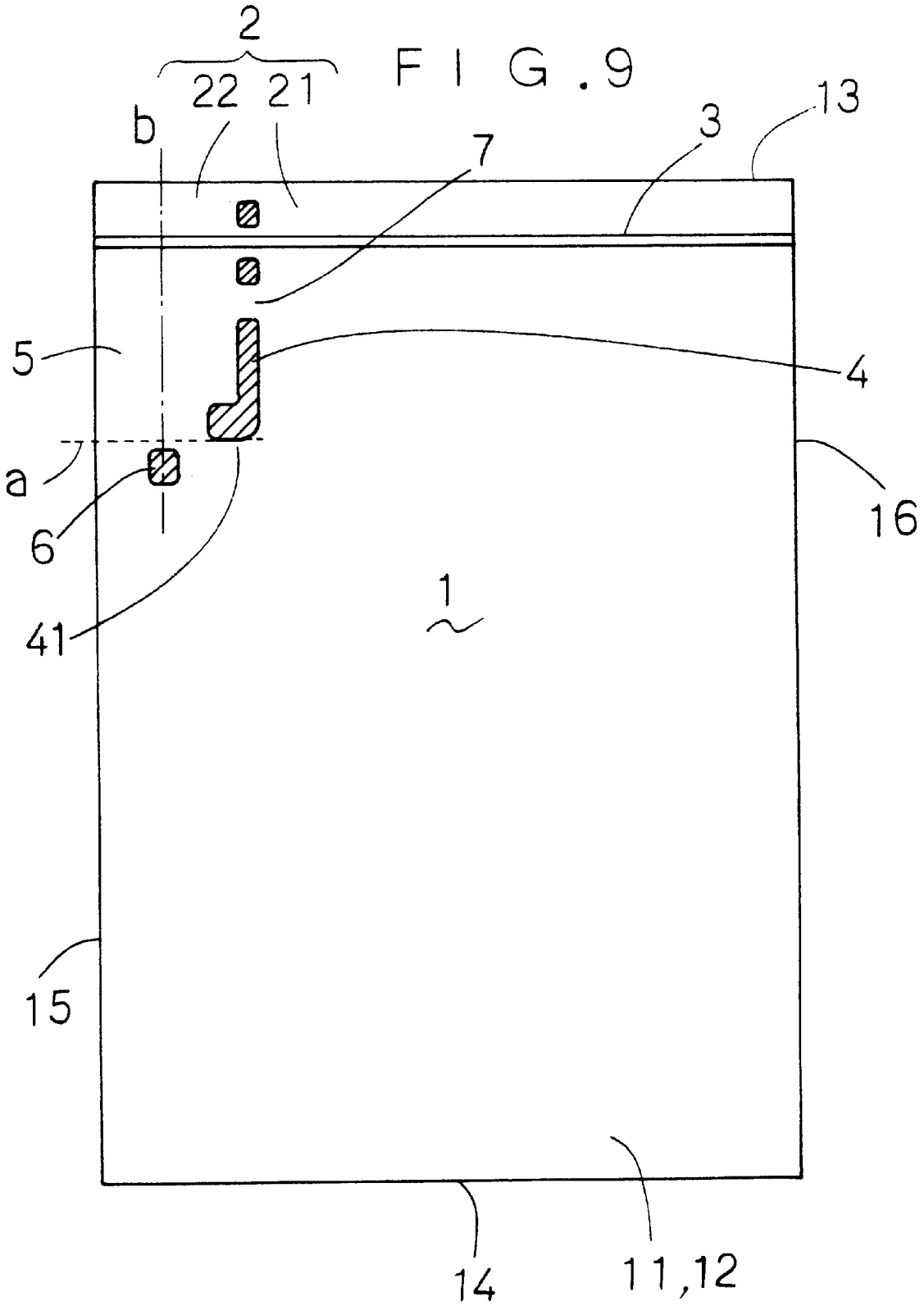
FIG. 9 is front view of a compression sack in accordance with further embodiment of the present invention.

FIG. 9 exemplifies another embodiment. The separating member 4 extends straightforward halfway, and at an end 41, it is bent almost at right angles in a direction of the deaeration passage 5. Said separating member 4 has an auxiliary deaeration passage 7 provided in a single place near and under the zipper 3. The spot seal 6 is substantially square having round corners and is disposed slightly below the inner end (a) of and on a center line (b) of the deaeration passage 5.

This configuration serves to prevent the formation of obstacles to deaeration which may be caused by a bend in the deaeration passage 5 during deaeration.

The specific shapes of the described elements are not limited to the foregoing. For example, said end 41 of the separating member 4 may not be bent substantially at right angles but tilted or curved. The spot seal 6 may be provided in a plurality of positions, and it may be made in the form of a circle, triangle, curved line, or popular character.

In a first embodiment of the present invention, the spot seal 6 is provided more inwardly of the sack than the end (a) at the interior side of the deaeration passage 5. This arrangement may prevent such articles as clothing contained in the compression sack 1 from being caught in the deaeration passage 5 when deaeration takes place.

In a second embodiment of the present invention, the provision of the auxiliary deaeration passage 7 in the separating member 4 may allow air to quickly flow out of the space 23 within the access port 21 of the sack. This makes the deaeration smooth.

In third and fourth embodiments of the present invention, the provision of the shut-off seals 8, 8, 8 or the liquid sealing portion 9 within the deaeration passage 5 makes it possible to prevent air from returning to the inside of the compression sack 1. Since said shut-off seals 8, 8, 8 are or liquid 9 is not intended to completely block the deaeration passage 5, deaeration can be performed smoothly.

In a fifth embodiment of the present invention, the separating member 4 is bent at the end (a) at the interior side of deaeration passage 5 in a direction of the deaeration passage 5. Such an arrangement prevents the formation of obstacles to deaeration caused by a bend in the deaeration passage 5 during deaeration. Further, it may prevent articles contained in this sack from being caught in the deaeration passage.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A compression sack constituted by non-breathable front and back sheets and having an opening formed in a part of the compression sack, said opening comprising an access port for articles and air outlet, and having a closing means provided therein for tight closing and opening purposes, wherein said access port and air outlet are separated by a separating member at which the front and back sheets are firmly joined together, said separating member extending from a side of the opening inwardly of the compression sack, thereby forming a deaeration passage between the air outlet and the inside of the compression sack, and a spot seal is provided more inwardly of the sack than the end at the interior side of the deaeration passage, wherein an auxiliary deaeration passage is provided more inwardly of the sack than a spot where the separating member and closing means cross each other.

2. The compression sack of claim 1, wherein shut-off seals are formed by firmly joining together the front and back sheets within the deaeration passage.

3. The compression sack of claim 1, wherein a shut-off valve formed as a liquid sealing portion containing an low viscosity liquid is disposed within the deaeration passage.

4. The compression sack of claim 1, wherein the separating member is bent at the end of the interior side of the deaeration passage in a direction of the deaeration passage.

5. A compression sack constituted by non-breathable front and back sheets and having an opening formed in a part of the compression sack, said opening comprising an access port for articles and air outlet, and having a closing means provided therein for tight closing and opening purposes, wherein said access port and air outlet are separated by a separating member at which the front and back sheets are firmly joined together, said separating member extending from a side of the opening inwardly of the compression sack, thereby forming a deaeration passage between the air outlet and the inside of the compression sack, and a spot seal is provided more inwardly of the sack than the end at the interior side of the deaeration passage, wherein the separating member is bent at the end of the interior side of the deaeration passage in a direction of the deaeration passage.

6. The compression sack of claim 5, wherein an auxiliary deaeration passage is provided more inwardly of the sack than a spot where the separating member and closing means cross each other.

7. The compression sack of claim 5, wherein shut-off seals are formed by firmly joining together the front and back sheets within the deaeration passage.

8. The compression sack of claim 6, wherein shut-off seals are formed by firmly joining together the front and back sheets within the deaeration passage.

9. The compression sack of claim 5, wherein a shut-off valve formed as a liquid sealing portion containing an low viscosity liquid is disposed within the deaeration passage.

10. The compression sack of claim 6, wherein a shut-off valve formed as a liquid sealing portion containing an low viscosity liquid is disposed within the deaeration passage.

11. The compression sack of claim 5, wherein the separating member is bent at the end of the interior side of the deaeration passage in a direction of the deaeration passage.

* * * * *